United States Patent [19]

Alshuk

[11] 4,244,025

[45] Jan. 6, 1981

[54] ROLLING MILL GAUGE CONTROL SYSTEM

[76] Inventor: Thomas J. Alshuk, Fenn Rd., Newington, Conn. 06111

[21] Appl. No.: 22,313

[22] Filed: Mar. 20, 1979

[51] Int. Cl.[3] ..... B21B 37/12; G05B 13/04

[52] U.S. Cl. ..... 364/472; 72/8; 72/16; 364/106; 364/116; 364/118

[58] Field of Search ..... 364/105, 106, 116, 118, 364/472, 474, 469, 552, 563; 72/16, 8

[56] References Cited

U.S. PATENT DOCUMENTS

| | | | |
|---|---|---|---|
| 3,561,237 | 2/1971 | Eggers et al. | 364/472 X |
| 3,574,279 | 4/1971 | Smith, Jr. | 364/472 X |
| 3,592,031 | 7/1971 | Sutton et al. | 364/472 X |
| 3,713,313 | 1/1973 | Spradlin | 364/472 X |
| 3,758,762 | 9/1973 | Littman et al. | 364/116 |
| 3,787,667 | 1/1974 | King | 364/472 |

*Primary Examiner*—Joseph F. Ruggiero

*Attorney, Agent, or Firm*—Prutzman, Kalb, Chilton & Alix

[57] ABSTRACT

An automatic gauge control system for screwdown adjustment of a cold rolling mill using separate feed-forward and feed-backward screwdown adjustments and wherein the feed-backward screwdown adjustment is based on the difference between a short term output gauge average and an input gauge rolling average which is adaptively modified with a statistical analysis of output gauge variations and wherein the feed-forward screwdown adjustment is based on a net weighted iput gauge variation adaptively controlled in accordance with a statistical analysis of input and output gauge variations.

16 Claims, 4 Drawing Figures

11
TRANSDUCER
40
12
14
18
SERVO VALVE
EX.
M
TACH
34
GAUGE LOGIC
20
STRIP LENGTH LOGIC
35
DIAGNOSTIC LOGIC
46
PROGRAMMED DIGITAL COMPUTER
26
FIXED & TRANSIENT DATA STORAGE
22
INCREMENTAL SCREWDOWN ADJUSTMENT CONTROL
31
30
SCREWDOWN INPUT LOGIC
32
CARD DATA INPUT TERMINAL
36
MANUAL DATA INPUT TERMINAL
37
MILL OPERATING CONTROLS
44
MANUAL SCREWDOWN CONTROL
42
MILL CONTROL DESK

ROLLING MILL GAUGE CONTROL SYSTEM

The present invention relates generally to rolling mill gauge control systems and more particularly to a new and improved adaptive gauge control system having notable utility in the automatic gauge control of a cold rolling mill having, for example, a Sendzimir type reversing mill stand.

It is a principal aim of the present invention to provide a new and improved mill screwdown model for combined feed-backward and feed-forward mill screwdown adjustments.

It is another aim of the present invention to provide a new and improved adaptive gauge control system using only workpiece travel and input and output gauge measurements, and employing a new and improved method of providing separate feed-forward and feed-backward corrective mill screwdown adjustments and of adaptively controlling the adjustments to reflect a statistical analysis of input and output gauge variations.

It is a further aim of the present invention to provide a new and improved method of determining feed-forward mill screwdown adjustments using input and output gauge measurements. In accordance with the present invention, a rolling succession of adaptively weighted incremental input gauge variations are employed in determining each feed forward mill screwdown adjustment.

It is another aim of the present invention to provide in an automatic gauge control system a new and improved method of determining screwdown adjustment and of providing adaptive control without requiring roll separating force measurement.

It is a further aim of the present invention to provide in an automatic gauge control system a new and improved method of determining feed-backward screwdown adjustment employing measured input and measured output gauge and a calculated input gauge based on an input rolling average adaptively modified to simulate measurable and theoretical mill parameters affecting the workpiece output gauge.

It is another aim of the present invention to provide a new and improved relatively low cost automatic gauge control system which provides accurate, adaptive gauge control. In accordance with the preferred embodiment of the present invention, workpiece travel and input and output gauge measurements are the only mill stand measurements used in the automatic gauge computation process, thereby substantially reducing the cost of the gauge control system without diminishing its accuracy and effectiveness.

Other subjects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENT

Figure 1:
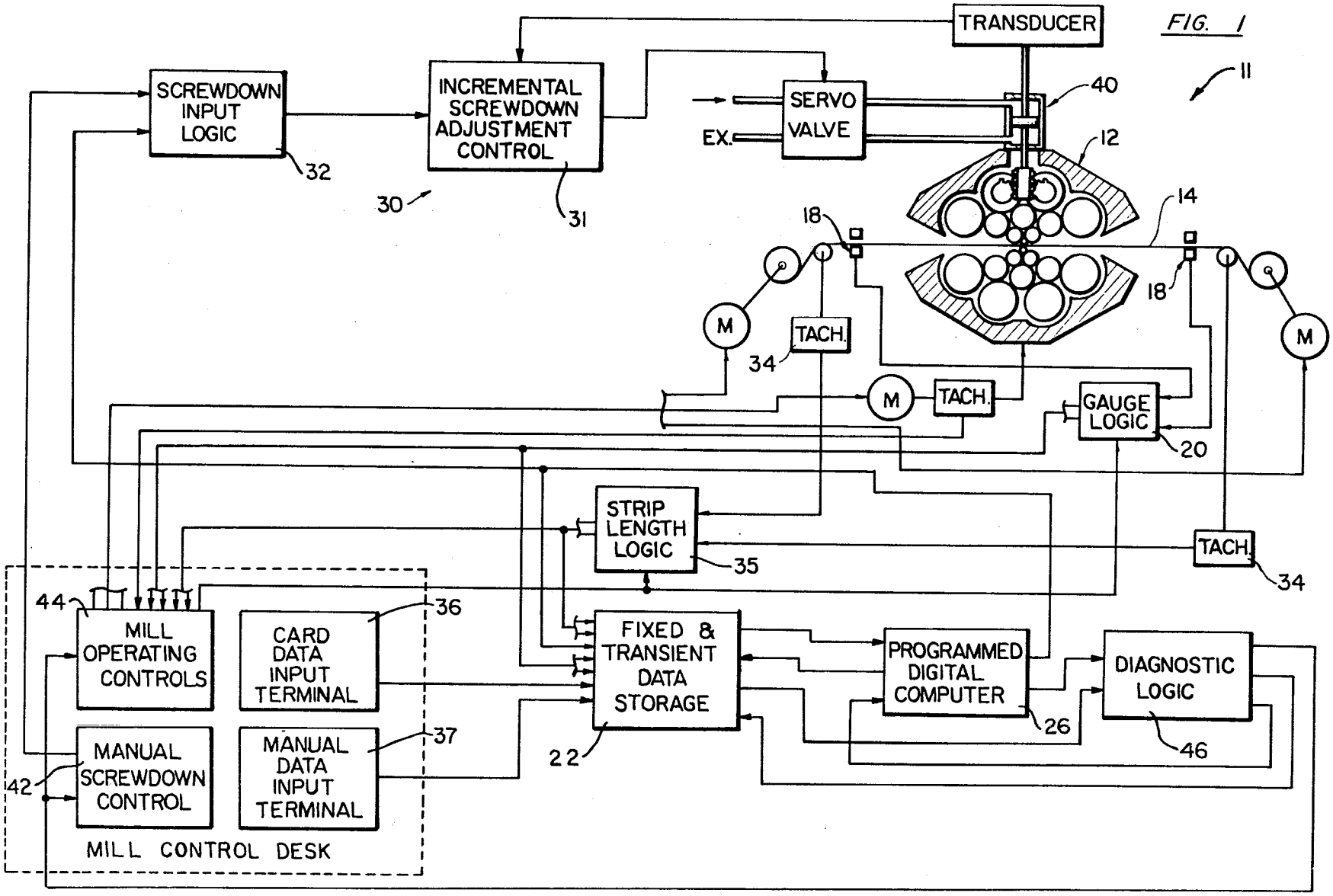
FIG. 1 is a combined schematic and diagrammatic view, partly broken away and partly in section, of a cold rolling mill incorporating an embodiment of a gauge control system of the present invention.

Referring now to the drawings in detail, an embodiment of an automatic gauge control system of the present invention is shown employed in a single stand cold roll reversing mill 11 having a 1-2-3-4 Sendzimir type stand 12, for controlling the output gauge or thickness of an elongated metal sheet or strip 14 passing between the two opposed inner or work rolls of the mill stand 12. The automatic gauge control system employs both feed-forward and feed-backward gauge control, and a suitable thickness gauge 18 is provided on each side of the mill stand 12 for use as an entrance or exit thickness gauge depending on the direction of operation of the reversing mill 11. The two gauges 18 are connected via a gauge logic circuit 20 to a suitable data memory or storage circuit 22 for subsequent use in operations performed by a programmed digital computer 26 as hereinafter described.

A suitable screwdown system 30 (for example, a screwdown system with a screwdown adjustment loop like that disclosed in U.S. Pat. No. 3,974,672, of John F. Herbst, entitled "Mill Hydraulic Screw-Down" and dated Aug. 17, 1976) is employed for adjusting the screwdown position and therefore the roll gap opening of the mill stand 12 for adjusting the output gauge or thickness of the rolled metal strip 14. An incremental screwdown adjustment control logic circuit 31 of the screwdown operating system 30 is connected via a suitable screwdown input logic circuit 32 to the digital computer 26 for automatic computer control of the output or thickness of the rolled metal strip as hereinafter described.

Also, suitable tachometers 34 (providing either workpiece speed signals or a workpiece length pulse for each predetermined length of rolled metal strip 14) are provided on opposite sides of the mill stand for use in determining the input and output travel of the rolled metal strip. The tachometers 34 are connected via a suitable strip length logic circuit 35 to the data storage circuit 22 for subsequent use in operations performed by the digital computer 26 as hereinafter described.

Additional predetermined data is transmitted via suitable data input terminals for storage in the data storage circuit 22 for subsequent use in operations performed by the digital computer 26 as hereinafter described. For example, a pass card provided for each rolling mill pass or a predetermined multiple pass rolling sequence and/or a suitable manually operable terminal 37 may be used for entering the required data, hereinafter described, into storage for subsequent use in operations performed by the digital computer. Such additional predetermined data includes the (a) nominal input or entrance gauge of the strip (hereinafter designated $G_{NI}$) for each rolling mill pass; (b) desired, preset or nominal output gauge of the metal strip (hereinafter designated $G_{NO}$) for each pass; and (c) mill spring constant (hereinafter designated $K_{Mill}$) of the mill stand 12. Also, if desired, the unloaded roll opening (hereinafter designated $R_O$) at the beginning of a multiple pass rolling sequence can be entered into storage, in which case the unloaded roll opening ($R_O$) is initially determined by the mill operator and entered into storage and is thereafter automatically updated by the computer 26 each time the screwdown position is incrementally adjusted by the gauge control system as hereinafter described. Preferably, prior to initiating each rolling mill pass, the mill operator (or, if desired, the automatic gauge control system if the existing unloaded roll opening ($R_O$) is provided in the data storage circuit) will adjust the mill stand screwdown to set the unloaded roll opening ($R_O$) to a predetermined or calculated roll opening in accordance with the nominal input gauge or thickness ($G_{NI}$) of the metal strip workpiece and the desired or nominal output gauge or thickness ($G_{NO}$).

In general, the loaded roll opening of the mill stand 12 is considered to equal the actual output or delivery gauge or thickness of the rolled metal strip workpiece (hereinafter designated $G_O$) under the usually justifiable assumption there is little or no elastic recovery of the metal strip workpiece after is passes beyond the exit gauge 18. Also, as is well known, in accordance with Hooke's law, the loaded roll opening under workpiece rolling conditions equals the unloaded roll opening ($R_O$) plus the mill stand stretch caused by the separating force (hereinafter designated F) between the inner work rolls of the mill stand 12 and which is equal and opposite to the rolling force on the metal strip workpiece.
Thus:

$$G_O = R_O + F/K_{Mill} \quad (1)$$

Where:
$G_O$=loaded roll opening or output gauge
$R_O$=unloaded roll opening
F=roll separating force
$K_{Mill}$=mill spring constant In the gauge control system of the present invention, a mill screwdown model is employed which provides separate and independent feed-forward and feed-backward mill screwdown adjustments without measuring roll separating force (F). Instead, in the feed-backward gauge control, a material deformation coefficient of the metal strip workpiece in process (hereinafter desgnated $C_{MD}$, and which is a coefficient of the rolling force required for reducing the gauge of the workpiece a predetermined amount) is determined from the ratio of a short-term output average thickness or gauge ($G_{AO}$) to a calculated strip input thickness or gauge ($G_{CI}$) using a mathematical model or data bank stored in the data storage circuit 22. The mathematical model or data bank which is used is actually based on the ratio of actual output and input thickness or gauge (i.e., $C_{MD}=f(G_O/G_I)$) but in the feed-backward gauge control system, an adaptively controlled calculated input gauge or thickness ($G_{CI}$) is employed in place of the actual input gauge or thickness ($G_I$). As hereinafter described, the calculated input gauge ($G_{CI}$) is calculated from a rolling input gauge average ($G_{AI}$) or, where a rolling input gauge average ($G_{AI}$) is not available, from the nominal input gauge ($G_{NI}$). Feed-backward adaptive control is achieved by modifying the calculated input gauge ($G_{CI}$), or nominal input gauge ($G_{NI}$) as the case may be, in a relatively simple but reliable manner which is generally similar to that disclosed in my U.S. Pat. No. 4,125,004 dated Nov. 14, 1978, and entitled "Rolling Mill Gauge Control System".

Figure 3:
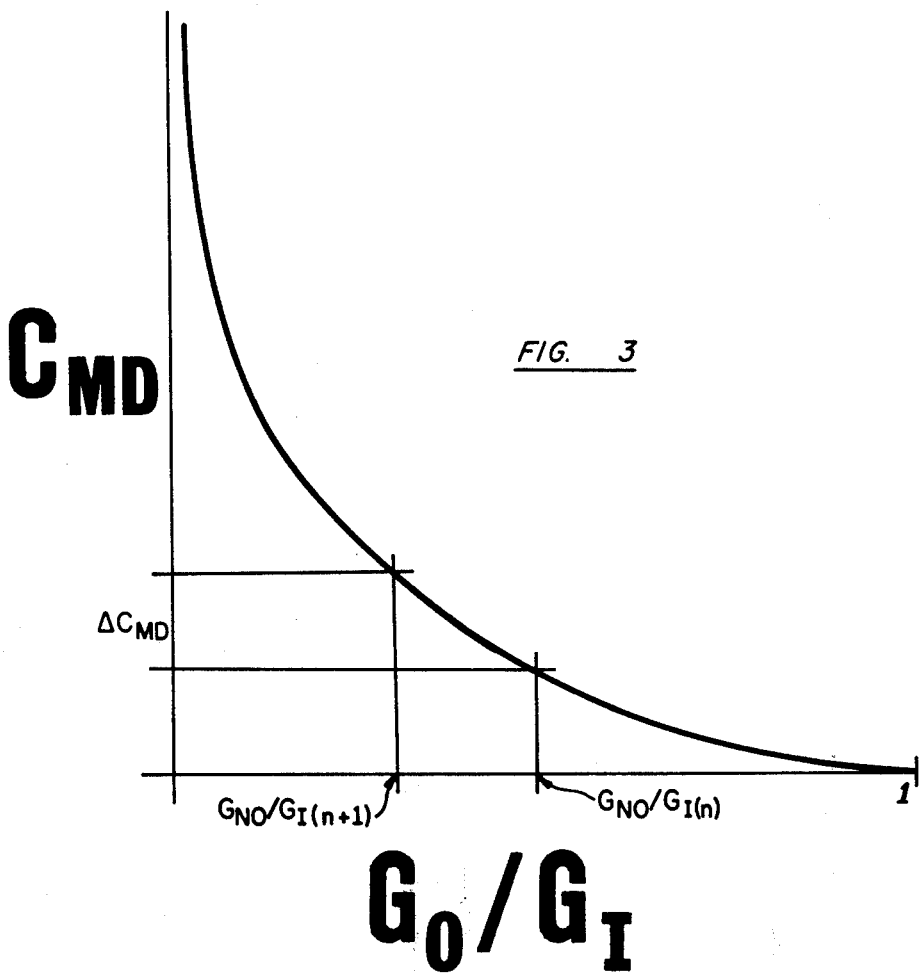
FIG. 3 is an exemplary graph of the relationship of a workpiece material deformation coefficient ($C_{MD}$) to the ratio of workpiece output and input gauges ($G_O/G_I$), and which relationship is employed in the screwdown adjustment model of the automatic gauge control system.

The mathematical model or data bank of the relationship of the workpiece material deformation coefficient ($C_{MD}$) to the ratio of output and input gauges or thickness ($G_O/G_I$) is suitably provided, for example, by a rolling pass card inserted into the card reader 36. A graph is shown in FIG. 3 illustrating the relationship of $C_{MD}$ to $G_O/G_I$, it being seen that $C_{MD}$ is "0" when the gauge ratio $G_O/G_I$ is "1" (i.e., there is no gauge reduction in the metal strip) and $C_{MD}$ increases exponentially as the gauge ratio $G_O/G_I$ decreases (i.e., as the percentage gauge reduction of the workpiece increases). Also it can be seen that the non-linear curve relationship becomes asymptotic to the Y axis as the gauge ratio $G_O/G_I$ approaches "0" (i.e., $G_O/G_I=0$ being an unattainable condition).

As previously indicated, the material deformation coefficient ($C_{MD}$) is used instead of roll separating force (F) in the automatic gauge control system. In that regard, the roll separating force (F) in assumed to be directly proportional to the material deformation coefficient ($C_{MD}$) in accordance with the following equation:

$$F = C_{MD} \cdot A \quad (2)$$

Where:
F=roll separating force.
$C_{MD}$=workpiece material deformation coefficient required for reducing the workpiece thickness from $G_I$ to $G_O$.
A=effective rolling area. (The effective rolling area (A) is a function of the strip width and mill stand work roll diameter and can be separately inserted into the data storage circuit 22 for example via a pass card inserted into the card reader 36. Alternatively the relationship of the product $C_{MD} \cdot A$ to the gauge ratio ($G_O/G_I$) can be inserted directly into the data storage circuit 22.)

The unloaded roll opening $R_O$ can therefore be determined by combining equations (1) and (2) as follows:

$$R_O = G_O - f(G_O/G_I) \cdot A/K_{Mill} \quad (3)$$

Thus, the actual screwdown position can be determined in accordance with the equation:

$$SD = R_O \cdot DR_S \cdot M \quad (4)$$

Where:
SD=screwdown position
$R_O$=unloaded roll opening
$DR_S$=approximate drive ratio of the screwdown mechanism which is predetermined and entered into data storage via the input terminal 36 or 37.
M=gain factor which is initially established and entered into data storage via the input terminal 36 or 37. The gain factor (M) provides for compensating for the difference between the predetermined screwdown drive ratio ($DR_S$) and the actual screwdown drive ratio during mill operating conditions. An adaptively controlled feed-backward gain factor ($M_B$) is employed for calculating the feed-backward screwdwon adjustment and an adaptively controlled feed-forward gain factor ($M_F$) is employed for calculating the feed-forward screwdown adjustment.

The unloaded roll gap ($R_O$) is preferably initially determined and then set (by the mill operator or mill computer 26 for a particular workpiece pass) using equations (3) and (4) above. The rolling mill is then operated with the mill operating controls 44 and during the following workpiece rolling operation, feed-backward screwdown adjustments of the mill stand are precisely made with the automatic gauge control system to regulate the workpiece output thickness by satisfying the following feed-backward screwdown adjustment equation based on the combination of equations (3) and (4) above:

$$\Delta SD_B = \Delta G_O(DR_S \cdot M_B) - \Delta f(G_O/G_{CI}) \cdot \frac{A \cdot DR_S \cdot M_B}{K_{Mill}} \quad (5)$$

Where:

$\Delta SD_B$ = feed-backward screwdown adjustment.

$\Delta G_O$ = the gauge error or difference between a short-term output gauge average ($G_{SO}$) and the desired or nominal output gauge or thickness ($G_{NO}$).

$\Delta f(G_O/G_{CI})$ = difference between the material deformation coefficient ($C_{MD}$) at the short-term output gauge average ($G_{SO}$) and the desired or nominal output gauge ($G_{NO}$) using a calculated or simulated input gauge ($G_{CI}$) in place of the actual input gauge or thickness ($G_I$).

The feed-backward screwdown adjustment ($\Delta SD_B$) is determined by the programmed digital computer 26 using the feed-backward screwdown adjustment model set forth in equation (5) and the feed-backward screwdown adjustment ($\Delta SD_B$) is then suitably transmitted to the screwdown input logic circuit 32 for making the desired screwdown adjustment with the mill stand screwdown motors 40 (only one hydraulic motor 40 being shown but two screwdown motors, hydraulic or electrical, being typically provided). Also, a suitable crown control (not shown) may be provided in the screwdown system for separate adjustment of the screwdown motors 40. Where the screwdown system 30 employs a screwdown adjustment loop with an add-/subtract reference counter (not shown) as in the aforementioned U.S. Pat. No. 3,974,672, a series of increment adjustment pulses (each representing for example 0.000050 inch adjustment of the screwdown motors 40) are transmitted to the screwdown system 30 for use in establishing the desired screwdown adjustment. Also, a suitable manual and/or secondary automatic screwdown control 42 is preferably provided for backup manual override operation of the screwdown system 30 and in performing preselected mill stand adjustment functions.

The digital computer 26 is preferably provided by a suitable large capacity microprocessor which has been appropriately programmed for calculating the screwdown adjustment as described herein.

The gauge control system provides for automatically continuously repeating the feed-backward screwdown adjustment calculation with a delay interval between calculation cycles established to be at least equal to the sum of the output transport delay (i.e. the delay for effecting any screwdown adjustment and for the strip to travel from the mill stand 12 to the output or exit gauge 18) and a succeeding output gauge averaging delay for determining a short-term output gauge average ($G_{SO}$) which reflects any screwdown adjustment from the immediately preceeding calculation cycle. Thus, the automatic feed-backward screwdown adjustment calculation cycles of the computer 26 are spaced so that each succeeding calculation is based on a new short-term output gauge average ($G_{SO}$) resulting from the immediately preceeding feed-backward calculation cycle. The short-term output gauge average ($G_{SO}$) is the average gauge of a plurality of successive contiguous output sample lengths of strip ($L_{OG}$), (which have corresponding input sample lengths of strip ($L_{IG}$), hereinafter described).

The length of each output strip sample ($L_{OG}$) is established to provide an accurate output gauge reading ($G_O$) and therefore is dependent on the gauge response time and the strip output speed. For example, a range of between six to fifteen output strip samples ($L_{OG}$), depending on the strip output speed, are used for establishing the short-term gauge average ($G_{SO}$).

The automatic feed-backward gauge control operates on the theory that workpiece output gauge or thickness errors, though potentially caused by one or more of a large number of measurable and theoretical rolling mill parameters, can be accurately and effectively compensated for through the use of a calculated input gauge or thickness ($G_{CI}$) which is determined by modifying an input gauge rolling average ($G_{AI}$). More particularly, the calculated input gauge ($G_{CI}$) for the feed-backward control is determined in accordance with the following equation:

$$G_{CI(n+1)} = G_{CI(n)} + (\Delta a_1 + a_2 \cdot \Delta S)\, G_{AI} \quad (6)$$

Where:

$G_{AI}$ = input gauge rolling average of successive sample input gauge measurements ($G_I$) along an input sample length of strip which is approximately two to four times the transport distance between the entrance gauge 18 and the mill stand 12. The same input gauge samples are also used, as hereinafter described, for feed-forward screwdown control using a queue or train of N gauge samples and the last 2N to 4N successive input gauge samples are used to determine the input gauge rolling average ($G_{AI}$). The nominal input gauge ($G_{NI}$) of the strip is used where an insufficient number of successive sample input gauge measurements are available for establishing the input gauge rolling average ($G_{AI}$).

$G_{CI(n+1)}$ = calculated gauge concurrently being determined.

$G_{CI(n)}$ = calculated input gauge determined by the last adaptive calculation cycle.

$\Delta a_1$ = change in an offset or steady state correction coefficient ($a_1$) since the last calculated input gauge ($G_{CI}$) determination.

$a_2$ = drift rate correction coefficient including any adjustment thereto since the last calculated input gauge ($G_{CI}$) determination.

S = linear travel (S) of the workpiece with respect to the delivery gauge 18 since the last calculated input gauge ($G_{CI}$) determination.

The offset or steady state correction coefficient ($a_1$) and drift rate correction coefficient ($a_2$) are employed for compensating for relatively long-term variations in rolling mill performance affecting workpiece output gauge or thickness. Although the parameters affecting workpiece output gauge do not have to be specifically identified, the longterm parameters include for example (a) long-term change in the hardness of the metal strip workpiece; (b) heating of the mill stand rolls and housing; and (c) heating and wear of the gauges 18. Numerous other relatively long-term parameters, both measurable and theoretical, are identified in the state of the art as affecting the rolled output thickness of the workpiece, and in effect all of such measurable and theoretical parameters are automatically compensated for with the feed-backward automatic gauge control. The offset coefficient ($a_1$) in the software mill model is automatically adjusted when a steady state workpiece output thickness error is detected, and the drift cancellation coefficient ($a_2$) in the software mill model is automatically adjusted as soon as the rate and direction of any workpiece output thickness drift have been established.

At the beginning of a rolling mill pass, the offset and drift coefficients ($a_1$ and $a_2$) are assigned preestablished values determined from prior mill rolling experience. Alternatively, where there is insignificant prior experience, the offset and drift coefficients are assigned values of, for example, $a_1=1$, and $a_2=0$ and whereby the calculated input gauge ($G_{CI}$) is initially made equal to the rolling input gauge average ($G_{AI}$) or to the nominal input gauge ($G_{NI}$) before a suitable rolling input gauge average ($G_{AI}$) is available. In either event, the initial offset and drift coefficients ($a_1$ and $a_2$) are inserted into storage for example by the pass card inserted into the card operated data input terminal 36.

As generally described in my aforementioned U.S. Pat. No. 4,125,004, a suitable statistical analysis of sample output gauge readings ($G_O$) comparing the sample output gauge readings ($G_O$) to the nominal or desired output gauge ($G_{NO}$), is employed during rolling mill operation for automatically revising the offset and drift coefficients ($a_1$ and $a_2$) and the feed-backward screwdown gain factor ($M_B$), and to stabilize the feed-backward screwdown adjustment equation (which in essence comprises equations (5) and (6) above) for automatically adjusting the established time intervals between feed-backward screwdown adjustment calculation cycles, between output gauge readings and between adaptive calculation cycles, and for automatically adjusting the methods of statistical analysis employed in the stabilization and offset and drift coefficient adjustments.

As can be seen from the foregoing, the feed-backward mill screwdown control is employed for adjusting the screwdown to compensate for the difference between the short-term output gauge average ($G_{SO}$) and the desired output gauge ($G_{NO}$) and also to compensate for relatively long-term variations in rolling mill performance affecting workpiece output gauge or thickness. The feed-forward mill screwdown control is operable independently of the feed-backward mill screwdown control and provides the primary control for adjusting the screwdown to compensate for variations in the input gauge, and in effect, the feed-backward control provides a followup check on the feed-forward control for making complementary mill screwdown adjustments.

For both feed-forward control and feed-backward control input gauge samples ($G_I$) are obtained via the entrance gauge 18 for each succeeding contiguous sample length of strip ($L_{IG}$) as the strip is fed to the rolling mill stand 12. The strip sample length ($L_{IG}$) is established to provide a good statistical gauge reading and therefore is made greater than the product of the gauge response time and the strip entrance speed and is automatically increased with the strip entrance speed. The strip sample length ($L_{IG}$), for example a 6" sample length, is also established to provide a train or queue of at least four or more successive input gauge readings or samples ($G_I$) along the input transport distance from the entrance gauge 18 to the mill stand 12. As hereinafter described, the feed-forward control uses the queue of input gauge samples ($G_I$) for adjusting the mill stand screwdown for each sample length ($L_{IG}$). Also, corresponding input and output sample lengths ($L_{IG}$ & $L_{OG}$) are employed (and the input and output gauge readings ($G_I$ & $G_O$) are made in synchronism) and whereby the expected output gauge from feed-forward screwdown adjustment can be subsequently compared with the actual output gauge reading ($G_O$).

In practice, the input gauge train or queue employs a plurality (N) of either 4, 8, 16, or 32 input gauge readings or samples ($G_I$) between the entrance gauge 18 and the mill stand 12. The number (N) of input gauge samples ($G_I$) is established so that:

$$N=(S_I-L_{SD})/L_{IG} \tag{7}$$

Where:

$S_I$=transport distance from the entrance gauge 18 to the mill stand roll gap.

$L_{SD}$=screwdown lead length which is equal to the product of the screwdown lead or response time and the strip entrance speed.

$L_{IG}$=input strip sample length which is adjusted to be greater than the product of gauge response time and strip entrance speed and, yet, to be sufficiently short to provide an adequate train or queue of 4, 8, 16, or 32 input gauge samples ($G_I$).

The feed-forward mill screwdown control provides a feed-forward screwdown adjustment cycle for determining or calculating an incremental feed-forward screwdown adjustment ($\Delta SD_F$) for each input sample length ($L_{IG}$) and for timely transmitting a corrective adjustment to the screwdown input logic circuit 32 as the sample length approaches the mill stand roll gap and when its distance from the mill stand 12 is equal to the screwdown lead length ($L_{SD}$).

With N input gauge samples ($G_I$) in the input gauge train or queue, there is a corresponding series of N incremental input gauge variations $\Delta G_{I(n+1)}$; $\Delta G_{I(n+2)}$ . . . $\Delta G_{I(N)}$; where $\Delta G_{I(n+1)}$ is the incremental input gauge variation ($G_{I(n+1)}$-$G_{I(n)}$) between the leading input gauge sample ($G_{I(n+1)}$) of the train or queue and the input gauge sample ($G_{I(n)}$) of the immediately preceding sample length at the mill stand 12 and for which any incremental corrective screwdown adjustment was determined by the immediately preceding feed-forward screwdown adjustment cycle. Similarly, $\Delta G_{I(n+2)}$ is the incremental input gauge variation ($G_{I(n+2)}$-$G_{I(n+1)}$) between the input gauge sample ($G_{I(n+2)}$) and input gauge sample ($G_{I(n+1)}$); and $\Delta G_{I(N)}$ is the incremental input gauge variation ($G_{I(N)}$-$G_{I(N-1)}$) between the last input gauge sample ($G_{I(N)}$) and the immediately preceding gauge sample ($G_{I(N-1)}$) of the input gauge queue.

A feed-forward screwdown adjustment ($\Delta SD_F$) is determined for each input sample length ($L_{IG}$) in accordance with an equation, hereinafter discussed, which is based on equation (5) modified (a) to reflect the assumption that the actual output gauge ($G_O$) is equal to the desired or nominal output gauge ($G_{NO}$) and therefore, $\Delta G_O$ is zero (O); and (b) to substitute the measured input gauge ($G_I$) for the calculated input gauge ($G_{CI}$). Thus:

$$\Delta SD_F = \Delta f(G_{NO}/G_I) \cdot \frac{A \cdot DR_S \cdot M_F}{K_{Mill}} \tag{8}$$

Where:

$\Delta SD_F$=feed-forward screwdown adjustment.

$G_{NO}$=desired or nominal output gauge or thickness.

$\Delta f(G_{NO}/G_I)$=difference in the material deformation coefficient ($C_{MD}$) between the actual input gauge or thickness ($G_{I(n+1)}$) of the next strip sample to be fed to the mill stand and the actual input gauge or thickness ($G_{I(n)}$) of the immediately preceding strip sample.

In equation (8), each feed-forward screwdown adjustment ($\Delta SD_F$) is based on a change in successive input gauge samples ($G_1$) and whereby the feed-forward screwdown adjustment provides for compensating for relatively shortterm input gauge variations. Equation (8) is modified in accordance with the equation:

$$f_1(G_{NO}/G_I)=f_2(C_{GR}\cdot\Delta G_{I(n+1)}/G_{I(n+1)}) \quad (9)$$

Where:

$C_{GR}$=a gauge ratio coefficient ($G_{NO}/G_{I(n)}$) initially assumed to be equal to $G_{NO}/G_{NI}$ and which is adaptively adjusted during the rolling mill pass.

$\Delta G_{I(n+1)}$=incremental input gauge variation between the gauge sample $G_{I(n+1)}$ and immediately preceding input gauge sample $G_{I(n)}$.

Equation (9) can be understood upon reference to FIG. 3 where it can be seen that:

$$\begin{aligned}\Delta C_{MD} &= \Delta f_1(G_O/G_1)\\ &= f_2(G_{NO}/G_{I(n+1)} - G_{NO}/G_{I(n)})\\ &= f_2(G_{NO}/G_{I(n)}\cdot\Delta G_{I(n+1)}/G_{I(n+1)})\\ &= f_2(C_{GR}\cdot\Delta G_{I(n+1)}/G_{I(n+1)})\end{aligned}$$

Combining equations (8) and (9) provides the following screwdown adjustment equation:

$$\Delta SD_F = f(C_{GR}\cdot\Delta G_I/G_I)\ .\ \frac{A\cdot DR_S\cdot M_F}{K_{Mill}} \quad (10)$$

The mathematical model or data bank of the relationship of workpiece deformation coefficient variation ($\Delta C_{MD}$) to the ratio $\Delta G_I/G_I$ (i.e. $\Delta C_{MD}=f(C_{GR}.\Delta G_I/G_I)$) is suitably provided, for example by a rolling pass card inserted into the card reader 36.

In determining the feed forward adjustment ($\Delta SD_F$) using equation (10), a net weighted input gauge variation ($\Delta G_{WI}$) is employed in place of the actual input gauge variation ($\Delta G_I$). The weighted input gauge variation ($\Delta G_{WI}$) is determined by summing individually weighted input gauge variations ($\Delta G_I$) of the input gauge train or queue in accordance with a geometric progression having a common factor (d). A weight of 1 (i.e. $d^0$) is applied to the leading incremental gauge variation $\Delta G_{I(n+1)}$; a weight of d is applied to the next succeeding incremental gauge variation $G_{I(n+2)}$; a weight of $d^2$ is applied to the next succeeding incremental gauge variation $G_{I(n+3)}$; and so on for all of the gauge samples in the input gauge queue.

Thus:

$$G_{WI} = \Delta G_{I(n+1)} + d\cdot\Delta G_{I(n+2)} + d^2\cdot G_{I(n+3)} + d^{N-1}\cdot G_{I(N)} \quad (11)$$

At the beginning of each rolling pass, the geometric or weighting factor (d) is set at slightly less than 1 (e.g. 0.9), and thereafter during the rolling pass is adaptively controlled between 0.1 and 1.0. When the weighting factor (d) is set at the upper end of its range, for example at 1.0 or close to 1.0, a feed-forward incremental screwdown adjustment ($\Delta SD_F$) is determined with equations (10) and (11) which reflects the net input gauge variation in the input gauge sample queue. In contrast, when the weighting factor (d) is set at the lower end of its range, a feed-forward incremental screwdown adjustment ($\Delta SD_F$) is determined which is based primarily on the leading incremental input gauge variation ($\Delta G_{I(n+1)}$).

After the net weighted incremental input gauge variation ($\Delta G_{WI}$) is determined for each input strip sample, the feed-forward screwdown adjustment ($\Delta SD_F$) is determined using $\Delta G_{WI}$ in place of $\Delta G_I$ in equation (10) above. Subject to an established adjustment limit, established for example in the range of 0.0005 inch to 0.001 inch for a Sendzimer type mill stand, the determined screwdown adjustment ($\Delta SD_F$) is transmitted to the screwdown input logic circuit 32 for making the desired screwdown adjustment with the mill stand screwdown motors 40.

The feed-forward screwdown adjustment limit is established in accordance with the screwdown response time and so that there is sufficient time for an incremental screwdown adjustment up to the established limit to be made and stabilized for effective mill stand rolling operation.

Suitable statistical analysis is employed during rolling mill operation for adaptively adjusting the feed-forward lead time and the feed-forward screwdown adjustment equations (10) (11) by adjusting the weighting factor (d), the feed-forward gain ($M_F$) and the gauge ratio coefficient ($C_{GR}$). The statistical analysis includes a comparison of the standard and peak deviations of the input samples ($G_I$) from the input gauge rolling average ($G_{AI}$) with the standard and peak deviations of the output strip samples ($G_O$) from an output gauge rolling average ($G_{AO}$). The output gauge rolling average ($G_{AO}$) is based on the last 2N to 4N successive output gauge samples ($G_O$). Also, the statistical analysis includes an analysis of expected and actual output gauge resulting from each feed-forward screwdown adjustment. As in the statistical analysis of the feed-backward control, the numbers of sample input and output gauge readings used in the statistical analysis are also adaptively adjusted.

As described in my aforementioned U.S. Pat. No. 4,125,004, a suitable diagnostic logic circuit 46 is employed in combination with the computer 26 for cycling the computer through suitable self-diagnostic routines between adaptive and screwdown calculation cycles of the computer to inspect the system and alert the system to any actual or impending fault conditions. The mill operator will be signaled when the system has found an uncorrectable fault and can then return the mill to manual control. If the diagnostic routines detect a serious fault (which could cause strip breakage, etc.) the automatic gauge control system will be deactivated and the mill will automatically return to manual operator control.

The operator can also manually override any computer control signals by using the normal controls at the main mill control desk, to which the control system gives priority over any signals generated by the computer.

Figure 2A:
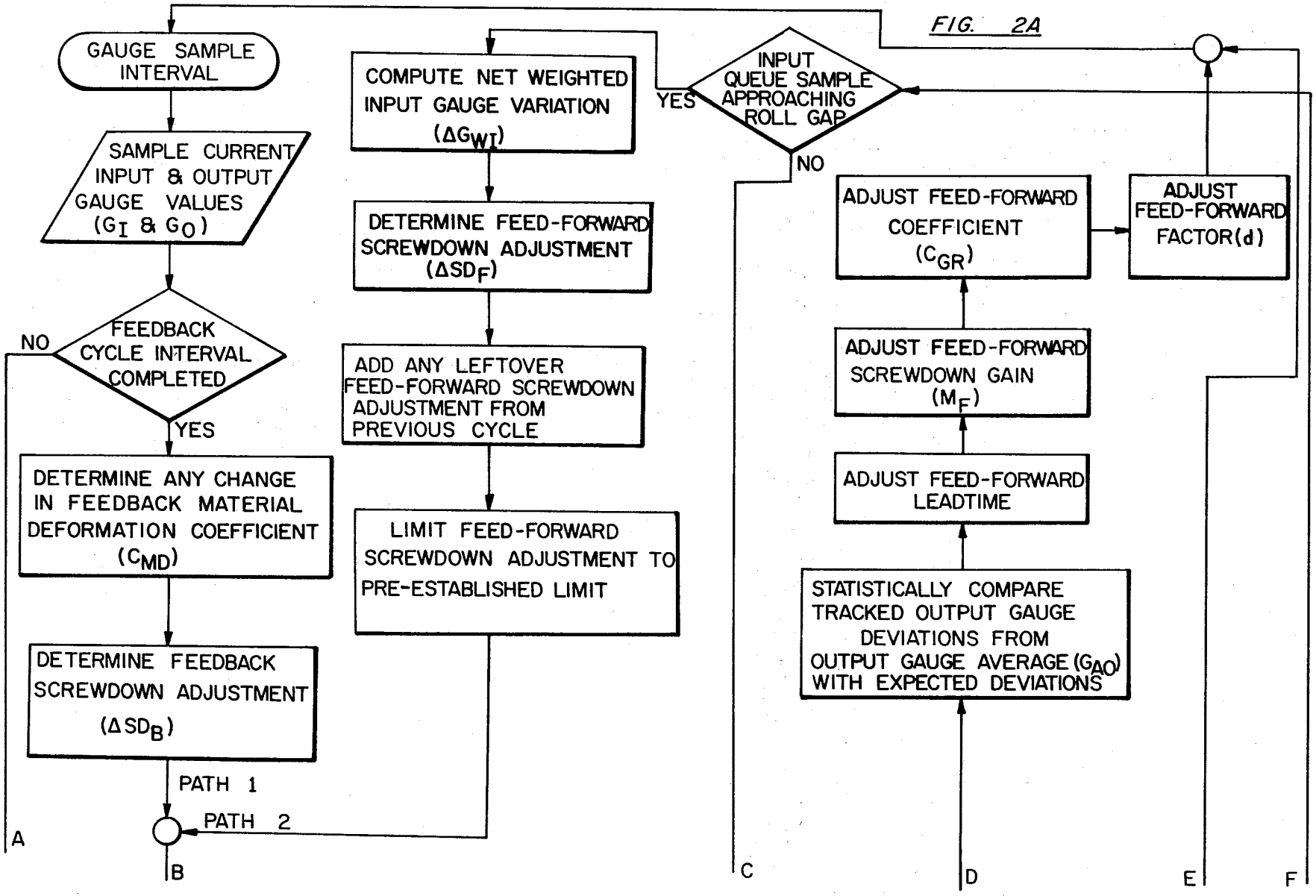
FIGS. 2A and 2B together provide a block diagram of the gauge control program employed in the gauge control system.
Figure 2B:
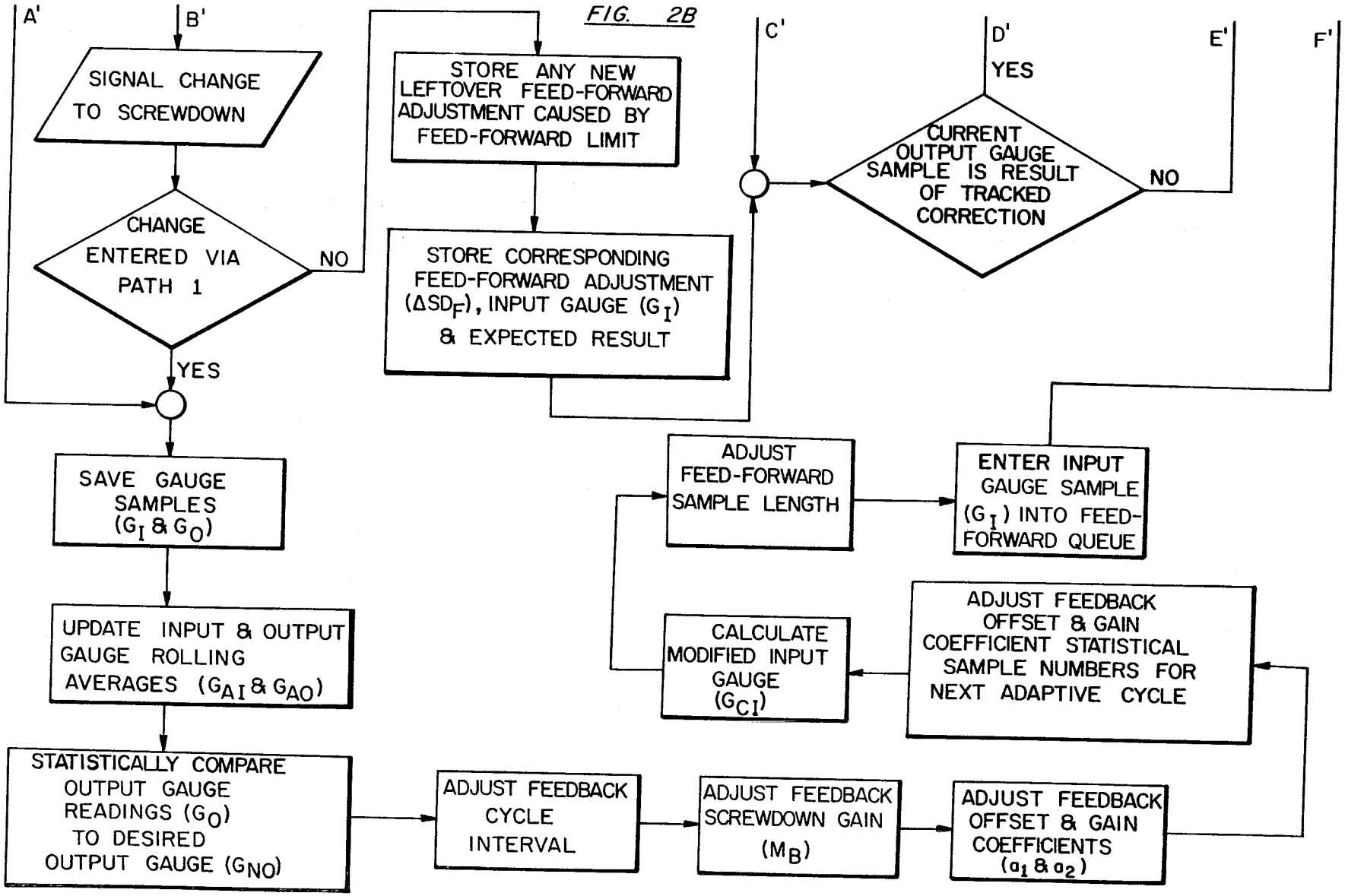

A block diagram of the gauge control program, excluding the diagnostic routines, is shown in FIG. 2. Briefly, the block entitled "Gauge Sample Interval"

represents the established interval between successive input gauge measurements ($G_I$) (or output gauge measurements ($G_O$) which are synchronized with the input gauge measurements ($G_I$)), and the gauge measurements are represented by the next block entitled "Sample Current Input & Output Gauge Values ($G_I$ & $G_O$)". The next block entitled "Feedback Cycle Interval Completed" represents the step of determining if the established interval between successive feed-backward screwdown calculation cycles has elapsed. If the required interval has elapsed, a new feed-backward screwdown calculation is effected and at the end of the feed-backward screwdown calculation cycle, a new feed-backward adaptive adjustment cycle is effected. If the feedback screwdown calculation interval has not yet elapsed, a new feed-backward adaptive adjustment cycle is effected, bypassing the feed-backward screwdown calculation cycle.

At the completion of the feed-backward adaptive adjustment cycle, the feed-forward sample length is adjusted and the feed-forward input gauge sample queue is updated. Thereafter, if timely, a feed-forward screwdown calculation cycle is effected and any leftover feed-forward adjustment from a prior feed-forward cycle is added to the newly calculated adjustment and any new leftover adjustment is stored for the succeeding cycle. Also, the feed-forward corrective adjustment and corresponding input gauge ($G_I$) and expected result are stored for subsequent adaptive statistical analysis.

At the completion of the feed-forward screwdown calculation cycle, either a feed-forward adaptive adjustment cycle is effected or the succeeding gauge sample interval is timed out to initiate a new program cycle.

In the feed-forward and feed-backward screwdown adjustment calculation cycles, each value revised or adjusted during the adaptive adjustment cycle is used until further revision during a subsequent adaptive adjustment cycle in the feed-forward and feed-backward screwdown calculation cycles in determining the corrective screwdown adjustments ($\Delta SD$).

As will be apparent to persons skilled in the art, various modifications, adaptations and variations of the foregoing specific disclosure can be made without departing from the teachings of the present invention.

I claim:

1. A gauge control system for a rolling mill having at least one mill stand with an adjustable screwdown for controlling the roll opening thereof through which a sheet metal workpiece is fed during a rolling mill run for reducing the thickness of the workpiece from an input gauge to an output gauge, screwdown adjustment means for adjusting the mill stand screwdown and thereby to adjust the roll opening and workpiece output gauge, means for measuring the input gauge ($G_I$) of each of a plurality of successive samples of the sheet metal workpiece to provide a rolling queue of a plurality of successive incremental gauge variations ($\Delta G_I$) for a plurality of successive sheet metal samples approaching the rolling mill; and computing means employing a predetermined mill screwdown adjustment model for determining any corrective incremental screwdown adjustment for each successive sheet metal sample for achieving a desired output gauge ($G_{NO}$) and employing a net weighted input gauge variation ($\Delta G_{WI}$) which is equal to a summation of said plurality of successive incremental gauge variations ($\Delta G_I$) successively weighted with successively decreasing weightings, the screwdown adjustment means being connected to be operated by the computing means for incrementally adjusting the mill screwdown for each successive sheet metal sample in accordance with any corrective incremental screwdown adjustment determined by said computing means, and said computing means being operable for adaptively adjusting said successively decreasing weightings, thereby to adaptively adjust the net weighted input gauge variation ($\Delta G_{WI}$).

2. A gauge control system according to claim 1 wherein said screwdown adjustment model employs the function $f(\Delta G_{WI(a)}/G_{I(a)})$ to determine any corrective screwdown adjustment where $\Delta G_{WI(a)}$ is the net weighted input gauge variation of a said succession of incremental gauge variations ($\Delta G_I$) having a lead variation $\Delta G_{I(a)}$ and where ($G_{I(a)}$) is the input gauge of the leading sheet metal sample approaching the rolling mill.

3. A gauge control system according to claim 1 or 2 wherein the successively decreasing weightings are related in accordance with a geometric progression having a common weighting factor (d).

4. A gauge control system according to claim 3 wherein said screwdown adjustment model provides for adaptively adjusting said common weighting factor (d) within a range having limits which do not exceed 0.1 and 1.0.

5. A gauge control system for a rolling mill having at least one mill stand with an adjustable screwdown for controlling the roll opening thereof through which a sheet metal workpiece is fed during a rolling mill run for reducing the thickness of the workpiece from an input gauge to an output gauge, screwdown adjustment means for adjusting the mill stand screwdown and thereby to adjust the roll opening and workpiece output gauge, means for measuring the input gauge ($G_I$) of each of a plurality of successive samples of the sheet metal workpiece to provide a rolling queue of a plurality of successive incremental gauge variations ($\Delta G_I$) for a plurality of successive sheet metal samples approaching the rolling mill and for measuring the output gauge ($G_O$) of corresponding sheet metal samples leaving the rolling mill, and computing means employing a predetermined mill screwdown adjustment model for determining separate feed-forward and feed-backward corrective incremental screwdown adjustments for achieving a desired output gauge ($G_{NO}$) and using rolling mill variables consisting primarily of the measured input gauge ($G_I$) and the measured output gauge ($G_O$) and with the feed-forward screwdown adjustments being based primarily on said gauge variations ($\Delta G_I$) and the feed-backward screwdown adjustments being based primarily on an input gauge rolling average ($G_{AI}$) and variations between selected output gauge averages ($G_{SO}$) respectively and the desired output gauge ($G_{NO}$), the screwdown adjustment means being connected to be operated by the computing means for incrementally adjusting the mill screwdown in accordance with any corrective incremental screwdown adjustment determined by said computing means.

6. A gauge control system for a rolling mill having at least one mill stand with an adjustable screwdown for controlling the roll opening thereof through which a sheet metal workpiece is fed during a rolling mill run for reducing the thickness of the workpiece from an input gauge to an output gauge, screwdown adjustment means for adjusting the mill stand screwdown and thereby to adjust the roll opening and workpiece output gauge, means for measuring the input gauge ($G_I$) of each of a plurality of successive samples of the sheet metal workpiece as they approach the rolling mill and for measuring the output gauge ($G_O$) of corresponding samples of the sheet metal workpiece after they leave the rolling mill, and computing means employing a predetermined mill screwdown adjustment model for determining any corrective screwdown adjustment for achieving a desired output gauge ($G_{NO}$) and using rolling mill running variables consisting primarily of the measured input gauge ($G_I$) and the measured output gauge ($G_O$), and determining feed-backward screwdown adjustments based essentially on selected output gauge averages ($G_{SO}$) and a calculated input gauge ($G_{CI}$) calculated from an input gauge rolling average ($G_{AI}$) and adaptively adjusted during the rolling mill run, the screwdown adjustment means being connected to be operated by the computing means for incrementally adjusting the mill screwdown in accordance with any corrective incremental screwdown adjustment determined by said computing means.

7. A gauge control system according to claim 6 wherein the predetermined mill screwdown adjustment model employs the quantity $\Delta f(G_O/G_{CI})$ to determine any corrective feed-backward screwdown adjustment ($\Delta SD_B$) where $\Delta f(G_O/G_{CI})$ is the difference in a predetermined workpiece material deformation coefficient function using the ratios of selected output gauge average ($G_{SO}$) and the desired output gauge ($G_{NO}$) respectively to said calculated input gauge ($G_{CI}$).

8. A method of providing output gauge control of a rolling mill having at least one mill stand with an adjustable screwdown for controlling the roll opening thereof through which a sheet metal workpiece is fed during a rolling mill run for reducing the thickness of the workpiece from an input gauge to an output gauge, comprising the steps of measuring the input gauge ($G_I$) of each of a plurality of successive samples of the sheet metal workpiece to provide a rolling queue of a plurality of successive incremental gauge variations ($\Delta G_I$) for a plurality of successive sheet metal samples approaching the rolling mill and measuring the output gauge ($G_O$) of corresponding sheet metal samples leaving the rolling mill, using computing means for determining corrective incremental screwdown adjustments for achieving a desired output gauge ($G_{NO}$) by employing a predetermined mill screwdown adjustment model using rolling mill running variables comprising measured input gauge ($G_I$) and measured output gauge ($G_O$), a net weighted input gauge variation ($\Delta G_{WI}$) which is equal to a summation of said plurality of successive incremental gauge variations ($\Delta G_I$) successively weighted with successively decreasing weightings, a selected output gauge average ($G_{SO}$) and an input gauge rolling average ($G_{AI}$) and by determining separate corrective feed-forward and feed-backwark incremental screwdown adjustments ($\Delta SD_F$) and ($\Delta SD_B$) respectively by employing said net weighted input gauge variation ($\Delta G_{WI}$) to determine a feed-forward adjustment ($\Delta SD_F$) and by employing said input gauge rolling average ($G_{AI}$) and said selected output gauge average ($G_{SO}$) to determine a feed-back adjustment ($\Delta SD_B$), and adjusting the mill screw-down in accordance with said separate corrective feed-forward and feed-backward incremental screwdown adjustments determined by the computing means.

9. A method of providing output gauge control of a rolling mill in accordance with claim 8, wherein the computing means is used to determine corrective feed-forward screwdown adjustments ($\Delta SD_F$) based on the feed-forward screwdown equation $\Delta SD_F = f(C_{GR}\Delta G_{WI}/G_I)$. $K_I$ where $f(C_{GR}\Delta G_{WI}/G_I)$ is a predetermined function of a change in material deformation coefficient resulting from a change in the ratio of the net weighted input gauge variation ($\Delta G_{WI}$) to the input gauge ($G_I$) of successive leading sample lengths of the rolling queue, where $C_{GR}$ is a function coefficient, and where $K_I$ is a predetermined system constant which includes the mill stand spring constant.

10. A method of providing output gauge control of a rolling mill having at least one mill stand with an adjustable screwdown for controlling the roll opening thereof through which a sheet metal workpiece is fed during a rolling mill run for reducing the thickness of the workpiece from an input gauge to an output gauge, comprising the steps of measuring the input gauge ($G_I$) of each of a plurality of successive samples of the sheet metal workpiece as they approach the rolling mill, measuring the output gauge ($G_O$) of corresponding sheet metal samples leaving the rolling mill, using computing means for determining corrective incremental screwdown adjustments for achieving a desired output gauge ($C_{NO}$) by employing a predetermined mill screwdown adjustment model using rolling mill running variables comprising primarily measured input gauge ($G_I$) and measured output gauge ($G_O$), and by determining separate corrective feed-forward and feed-backward incremental screwdown adjustments ($\Delta SD_F$) and ($\Delta SD_B$) respectively by employing an input gauge variation ($\Delta G_{WI}$) which is based on a plurality of successive incremental gauge variations ($\Delta G_I$) to determine a feed-forward adjustment ($\Delta SD_F$) and by employing an input gauge average ($G_{AI}$) based on the measured input gauge ($G_I$) and an output gauge average ($G_{SO}$) based on the measured output gauge ($G_O$) to determine a feed-back adjustment ($\Delta SD_B$), and adjusting the mill screwdown in accordance with said separate corrective feed-forward and feed-backward incremental screwdown adjustments determined by the computing means.

11. A method of providing output gauge control of a rolling mill in accordance with claim 10 wherein the predetermined mill screwdown adjustment model comprises separate feed-forward and feed-backward adaptive control and further comprising the step of using the computing means to automatically adaptively control the feed-forward adjustment ($\Delta SD_F$) and feed-backward adjustments ($\Delta SD_B$) by statistical analysis of the measured output gauge ($G_O$).

12. A method of providing output gauge control of a rolling mill in accordance with claim 10 wherein the input gauge variation ($\Delta G_{WI}$) is equal to a summation of a rolling queue of a plurality of successive incremental gauge variations ($\Delta G_I$) for a plurality of successive sheet metal samples approaching the rolling mill successively weighted with successively decreasing weightings and wherein said automatic adaptive control comprises adaptively adjusting said successive weightings.

13. A method of providing output gauge control of a rolling mill in accordance with claim 11 wherein said automatic adaptive control step using the computing means comprises automatic adaptive control of the feed-forward adjustment by statistical analysis of the variations between measured output gauge ($G_O$) and an average output gauge ($G_{AO}$).

14. A method of providing output gauge control of a rolling mill having at least one mill stand with an adjustable screwdown for controlling the roll opening thereof through which a sheet metal workpiece is fed during a rolling mill run for reducing the thickness of the workpiece from an input gauge to an output gauge, comprising the step of measuring the input gauge ($G_I$) of each of a plurality of successive samples of the sheet metal workpiece as they approach the rolling mill, measuring the output gauge ($G_O$) of corresponding sheet metal samples leaving the rolling mill, using computing means for determining corrective incremental screwdown adjustments for achieving a desired output gauge ($G_{NO}$) by employing a predetermined mill screwdown adjustment model using rolling mill running variables comprising primarily measured input gauge ($G_I$) and measured output gauge ($G_O$), and by determining feed-backward incremental screwdown adjustments ($\Delta SD_B$) by employing an input gauge average ($G_{AI}$) and an output gauge average ($G_{SO}$), and adjusting the mill screwdown in accordance with said feed-backward incremental screwdown adjustments determined by the computing means.

15. A method of providing output gauge control of a rolling mill in accordance with claim 14 wherein the computing means is used to determine corrective feed-backward screwdown adjustments ($\Delta SD_B$) based on the feed-backward screwdown equation $$\Delta SD_B = \Delta G_O \cdot K_2 - \Delta f(G_O/G_{CI}) \cdot K_3$$

where $G_{CI}$ is a calculated input gauge based on the average input gauge ($G_{AI}$), $\Delta f(G_O/G_{CI})$ is the difference in a predetermined workpiece material deformation coefficient function using the ratios of output gauge average ($G_{SO}$) and the desired output gauge ($G_{NO}$) respectively to said calculated input gauge ($G_{CI}$), where $\Delta G_O$ is the difference between the output gauge average ($G_{SO}$) and the desired output gauge ($G_{NO}$) and wherein $K_2$ and $K_3$ are predetermined system constants.

16. A method of providing output gauge control of a rolling mill having at least one mill stand with an adjustable screwdown for controlling the roll opening thereof through which a sheet metal workpiece is fed during a rolling mill run for reducing the thickness of the workpiece from an input gauge to an output gauge, comprising the step of measuring the input gauge ($G_I$) of each of a plurality of successive samples of the sheet metal workpiece to provide a rolling queue of a plurality of successive incremental gauge variations ($\Delta G_I$) for a plurality of successive sheet metal samples approaching the rolling mill and measuring the output gauge ($G_O$) of corresponding sheet metal samples leaving the rolling mill, using computing means for determining corrective incremental screwdown adjustments for achieving a desired output gauge ($G_{NO}$) by employing a predetermined mill screwdown adjustment model using a net weighted input gauge variation ($\Delta G_{WI}$) which is equal to a summation of said plurality of successive incremental gauge variations ($\Delta G_I$) successively weighted with successively decreasing weightings and by determining corrective feed-forward incremental screwdown adjustments ($\Delta SD_F$) from said net weighted input gauge variations ($\Delta G_{WI}$), adjusting the mill screwdown in accordance with said corrective feed-forward incremental screwdown adjustments determined by the computing means, and automatically adaptively controlling the feed-forward incremental screwdown adjustments by adaptively adjusting said successive weightings by statistical analysis of the measured output gauge ($G_O$).

* * * * *